US011866246B1

(12) United States Patent
Green

(10) Patent No.: US 11,866,246 B1
(45) Date of Patent: Jan. 9, 2024

(54) FACE AND BODY SCRUB DISPENSING DEVICE

(71) Applicant: Jaquette Chardae Green, Alexandria, VA (US)

(72) Inventor: Jaquette Chardae Green, Alexandria, VA (US)

( * ) Notice: Subject to any disclaimer, the term of this patent is extended or adjusted under 35 U.S.C. 154(b) by 0 days.

(21) Appl. No.: 18/076,561

(22) Filed: Dec. 7, 2022

(51) Int. Cl.
*B65D 83/00* (2006.01)
*A45D 40/00* (2006.01)
*A47K 5/12* (2006.01)

(52) U.S. Cl.
CPC ..... *B65D 83/0077* (2013.01); *A45D 40/00* (2013.01); *A47K 5/1201* (2013.01); *B65D 83/0038* (2013.01)

(58) Field of Classification Search
CPC .. B65D 83/0038; B65D 83/0077; A47K 5/12; A47K 5/122
USPC ..... 222/386, 386.5, 389, 206–215
See application file for complete search history.

(56) References Cited

U.S. PATENT DOCUMENTS 1,206,661 A * 11/1916 Booth ..... B65D 47/2031 222/511
1,459,871 A * 6/1923 Bakken ..... F16N 3/06 222/214
2,471,852 A * 5/1949 Robert ..... B65D 83/0072 222/326
2,635,789 A * 4/1953 Gabler ..... B65D 83/0027 222/327
3,128,923 A * 4/1964 Gabler ..... A45D 40/0075 222/546
3,338,481 A * 8/1967 Pollak ..... B65D 83/0038 92/245
3,339,809 A * 9/1967 Church ..... B65D 35/46 222/215
3,471,349 A * 10/1969 Bosworth ..... B05B 9/047 222/391
4,136,802 A * 1/1979 Mascia ..... B05B 9/0838 222/340
4,160,513 A * 7/1979 Cockerham ..... A47K 5/1211 222/327

(Continued)

FOREIGN PATENT DOCUMENTS

KR 102188511 B1 12/2020

*Primary Examiner* — Donnell A Long
*Assistant Examiner* — Randall A Gruby
(74) *Attorney, Agent, or Firm* — Argus Intellectual Enterprise, LLC; Jordan Sworen; Daniel Enea

(57) ABSTRACT

A device for dispensing body scrub. The device includes a globe-shaped housing having an interior volume that can retain body scrub within a second side thereof. The housing is movable between a deformed and a nondeformed configuration and includes a dividing wall disposed within the interior volume. The dividing wall separates the first side from the second side and is movable therebetween via a spring. The spring is biased towards an expanded configuration such that when the housing is deformed, the spring pushes the dividing wall towards the second side thereby forcing the body scrub through an opening within the housing. A valve is disposed at the opening and allows the body scrub to be dispensed therefrom when the housing is deformed upon force applied towards the second side. The valve is closed when pressure is released from the interior volume causing the housing to return to the non-deformed configuration.

19 Claims, 2 Drawing Sheets

(56) References Cited

U.S. PATENT DOCUMENTS

| | | | | |
|---|---|---|---|---|
| 4,193,513 | A * | 3/1980 | Bull, Jr. | G01F 11/02 222/105 |
| 4,756,450 | A * | 7/1988 | Negaty-Hindi | B67D 3/00 222/391 |
| 4,928,857 | A | 5/1990 | Ecker | |
| 4,964,852 | A | 10/1990 | Dunning et al. | |
| 5,373,967 | A | 12/1994 | Grooms et al. | |
| 5,685,456 | A * | 11/1997 | Goldstein | B05B 9/0838 222/340 |
| D479,779 | S | 9/2003 | Zhao | |
| 6,705,492 | B2 | 3/2004 | Lowry | |
| 6,789,707 | B2 * | 9/2004 | Wright | B65D 83/0077 222/326 |
| 6,860,404 | B2 * | 3/2005 | Duqueroie | B05B 11/043 222/211 |
| 7,878,374 | B2 * | 2/2011 | Decottignies | A45D 40/20 222/491 |
| 8,042,710 | B2 | 10/2011 | Heijden | |
| 8,408,426 | B2 * | 4/2013 | Bakhos | B65D 81/245 222/105 |
| 9,629,311 | B2 * | 4/2017 | Park | A01G 7/06 |
| 10,159,385 | B2 | 12/2018 | Beckerman et al. | |
| 10,618,702 | B1 * | 4/2020 | Alexander | B65D 25/54 |
| 10,638,825 | B2 | 5/2020 | Legastelois et al. | |
| 2002/0153389 | A1 | 10/2002 | Creaghan et al. | |
| 2005/0223637 | A1 * | 10/2005 | Black | B65D 83/0038 47/57.5 |
| 2008/0105708 | A1 * | 5/2008 | Ebikawa | H01M 8/04208 222/339 |
| 2013/0008922 | A1 * | 1/2013 | Shen | B65D 83/0038 222/340 |
| 2013/0047981 | A1 * | 2/2013 | Bacon | B65D 83/62 128/200.23 |

* cited by examiner

FACE AND BODY SCRUB DISPENSING DEVICE

BACKGROUND OF THE INVENTION

The present invention relates to face and body scrub dispensing devices. The present invention further provides a globe-shaped housing that can retain body scrub within a second side thereof and is movable between a deformed and a nondeformed configuration to allow body scrub to be easily dispensed through a one-way valve without the introduction of liquid from entering the housing upon dispensing the body scrub.

Body scrubs are considered physical exfoliants because they contain mostly solid, sand like material used to exfoliate the skin. These products are generally used when showering or bathing for the convenience of washing off the body scrub after use. The granular material is often mixed with a minor amount of oil to allow the sand-like material to adhere together in use. Body scrub is often provided in jar like containers that allow a user to stick multiple fingers or even an entire hand within the jar. Unfortunately, this also allows liquid to be introduced into the jar when used when showering or bathing. The added liquid can degrade the quality of the body scrub. Additionally, other contaminants can be introduced into the unused product depending on the cleanliness of the user's hand. The jar remains uncovered until the user has a free hand or the ability to recover the body scrub, which often involves screwing a cap back on the jar.

Conventional body scrubs cannot be provided in pump-like dispensers that are often used for liquid soaps and even more viscous liquids because the exfoliants become stuck within the pump and other mechanical components, preventing operation thereof. For example, typical liquid dispensers having a plunger that serves to force liquid from the housing is inefficient as a body scrub dispenser because the exfoliant cannot pass through the valve thereof. Furthermore, gravity fed dispensers that allow liquid to dispense therefrom without any additional force are not adequate for dispensing a body scrub up to 75% solids therein. Therefore, there exists a need for a dispenser specifically designed for dispensing body scrubs while preventing the introduction of liquid and other contaminants during dispensing.

In light of the devices disclosed in the known art, it is submitted that the present invention substantially diverges in design elements and methods from the known art and consequently it is clear that there is a need in the art for an improvement for body scrub dispensing devices. In this regard the instant invention substantially fulfills these needs.

SUMMARY OF THE INVENTION

In view of the foregoing disadvantages inherent in the known types of body scrub dispensing devices present in the known art, the present invention provides a new body scrub dispensing device for dispensing body scrub while preventing the introduction of liquid and other contaminants during dispensing.

It is an objective of the present invention to provide an embodiment of the body scrub dispensing device comprising a housing having an interior volume that can retain body scrub within a second side thereof. The housing is movable between a deformed and a nondeformed configuration and includes a dividing wall disposed within the interior volume. The dividing wall separates a first side from the second side and is movable therebetween via a spring. The spring is biased towards an expanded configuration such that when the housing is deformed, the spring pushes the dividing wall towards the second side thereby forcing the body scrub through an opening within the housing.

It is an objective of the present invention to provide an embodiment of the body scrub dispensing device comprising a one-way valve disposed at an opening of the housing and allows the body scrub to be dispensed therefrom when the housing is deformed upon force applied towards the second side. The valve is closed when pressure is released from the interior volume causing the housing to return to the nondeformed configuration.

It is another objective of the present invention to provide an embodiment of the body scrub dispensing device wherein the housing comprises a globe-shape with a flat base configured to support the housing in an upright position on a horizontal surface.

It is yet another objective of the present invention to provide a body scrub dispensing device comprising an elongated spout extending from the opening of the housing, wherein the spout is removable from the housing to enable the housing to receive body scrub therein.

It is therefore an object of the present invention to provide a new and improved body scrub dispensing device that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for dispensing body scrub. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment. Additionally, repeated use of the term "body scrub" is interchangeable with the term "lip and body scrub", and "physical exfoliant".

Figure 1:
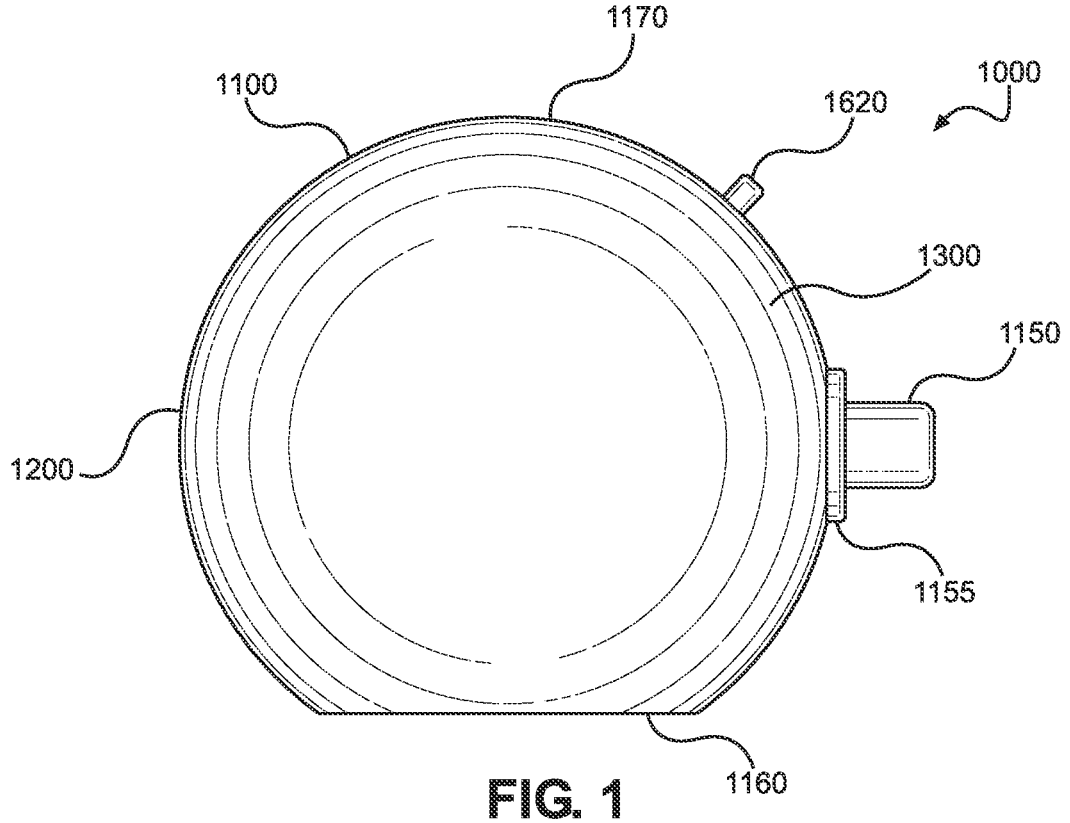
FIG. 1 shows a perspective view of an embodiment of the face and body scrub dispensing device.
Figure 2:
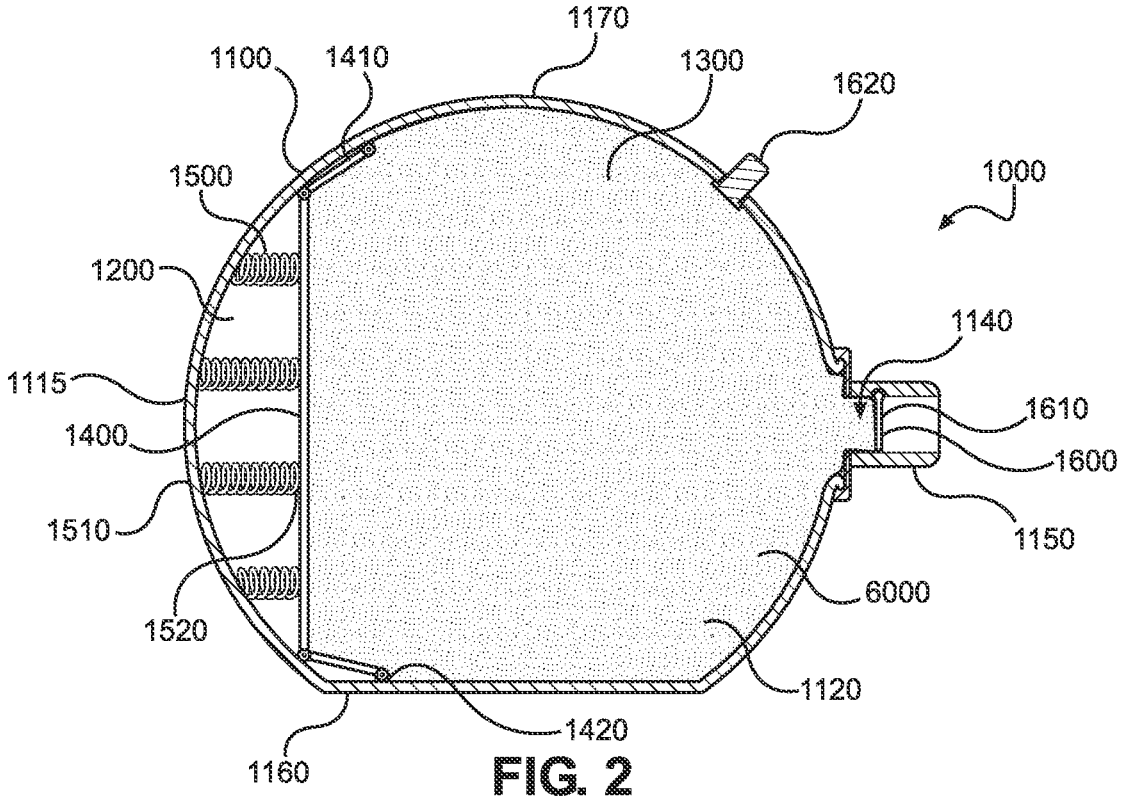
FIG. 2 shows a cross sectional view of the embodiment of the face and body scrub dispensing device wherein the housing is in a nondeformed configuration.

Referring now to FIGS. 1 and 2, there is shown a perspective view of an embodiment of the face and body scrub dispensing device and a cross sectional view of the embodiment of the face and body scrub dispensing device wherein the housing is in a nondeformed configuration, respectively. In the illustrated embodiment, the body scrub dispensing device 1000 comprises a housing 1100 having an interior volume 1120 with a first side 1200 and a second side 1300. A dividing wall 1400 is disposed within the interior volume 1120 and is configured to separate the first side 1200 from the second side 1300, wherein the body scrub 6000 is maintained on the second side 1300. An opening 1140 having a spout 1150 connected thereto is disposed on the second side 1300 and configured to dispense the body scrub therethrough. In the illustrated embodiment, the spout is removably secured to the housing 1100 via a threaded neck 1155 to enable the housing to receive body scrub therein.

In the illustrated embodiment, the face and body scrub dispensing device 1000 is configured to dispense a physical exfoliant that can be applied anywhere on a user's body, including the head, face, lips, neck, and therebelow. In some embodiments, the face and body scrub dispensing device 1000 includes the body scrub therein. In the illustrated embodiment, the body scrub 6000 comprises 25%-75% of solid exfoliant material by volume, wherein the remaining volume comprises an oil and other additives.

In the illustrated embodiment, the housing 1100 is composed of any suitable material wherein the second side is configured to deform when external pressure is applied thereto. In the illustrated embodiment, the entire housing 1100 is composed of a same material. However, in alternate embodiments, the first side of the housing is composed of a more rigid material than the second side, such that the first side will not deform upon a standard amount of squeezing pressure applied from a user. In other embodiments, the first side is composed of a rigid material, such as rigid plastic or glass, whereas the second side is composed of a bladder adapted to compress and expand.

In the illustrated embodiment, the housing 1100 comprises a globe-shape having a flat base 1160 adapted to support the housing 1100 in an upright configuration on a horizontal surface. The purpose of a rounded or globe shaped upper side of the housing 1100 is to provide a comfortable surface area for compressing to dispense the body scrub from the housing 1100. In the illustrated embodiment, the housing 1100 comprises a circle shaped cross section at each section about the lateral axis. In alternate embodiments, the housing comprises any suitable shape, such as a cylindrical shape or irregular shaped housing.

In the illustrated embodiment, the dividing wall 1400 extends between a height and lateral sides of the housing 1100 perpendicular to the base 1160, wherein the height is measured between the base 1160 and an opposing upper end 1170 of the housing. In this way, the dividing wall forms a substantial cross section of the housing. The dividing wall 1400 comprises a substantially planar member and is movable along a lateral axis, wherein the lateral axis is measured between the first and second sides 1200, 1300. In some embodiments having different heights disposed along the lateral axis of the housing 1100, such as the shown embodiment, the dividing wall 1400 comprises a pair of arms 1410 that are hingedly secured to opposing sides of the dividing wall 1400. In some embodiments, the dividing wall and/or arms are concave or convex which may assist with the pressure application when contacting the body scrub.

In the illustrated embodiment, the arms 1410 are biased towards an extended configuration, wherein the extended configuration the arms 1410 linearly aligned with the dividing wall 1400. The arms 1410 are intended to extend the length of the dividing wall 1400 as the dividing wall moves from a shorter height to a larger height of the housing 1100. In the illustrated embodiment, the pair of arms 1410 are configured to move with the dividing wall 1400 wherein the distal end of each arm is configured to remain in constant contact with the interior wall of the housing while preventing body scrub from passing to the first side of the housing. As the dividing wall 1400 moves from a larger height to a shorter height of the housing, the arms 1410 will pivot to allow the dividing wall 1410 to move towards the second side 1300 while preventing a gap to form between the first side and second side, thereby preventing body scrub from passing to the first side as the dividing wall moves. In some embodiments, the dividing wall is void of arms and is movable along a uniform length of the housing, wherein the uniform length determines the distance the dividing wall is capable of moving. In other embodiments, the distal end of each arm 1410 is pivotally secured to the interior wall of the housing 1100, wherein the dividing wall 1400 moves from the first side to the second side and pivots about the proximal end of each arm 1410.

In the illustrated embodiment, a seal 1420 is disposed at each end of the dividing wall 1400. The seals 1420 are configured to prevent body scrub from passing from the second side 1300 of the housing 1100 to the first side 1200 thereof. The seals 1420 remain in contact with the interior surface of the housing 1100 as the dividing wall 1400 moves. The seal 1420 is composed of any suitable material such as rubber and comprises any suitable configuration such as a small protrusion having a curved exterior.

In the illustrated embodiment, the dividing wall 1400 is moved within the housing 1100 by at least one spring, wherein the spring is biased towards an expanded configuration such that the spring 1500 asserts a constant force against dividing wall 1400 pushing it towards the second side 1300. In the illustrated embodiment, a plurality of springs 1500 is disposed within the first side 1200 of the housing 1100. Each spring 1500 comprises a first end 1510 and a second end 1520, wherein the first end 1510 is secured to a sidewall 1115 of the housing 1100 on the first side 1200 thereof and the second end is secured to the dividing wall 1400.

In the illustrated embodiment, a one-way valve 1600 disposed at the opening 1140, wherein the valve 1600 is configured to open as the body scrub 6000 is dispensed through the opening 1140 upon force applied to the housing 1100. In the shown embodiment, the valve 1600 comprises a gate 1610 hingedly secured to a sidewall of the spout 1150. The gate 1610 comprises a substantially same length as a diameter of the opening 1140 and spout 1150 such that when the gate 1610 is closed, the opening 1140 is covered by the gate 1610. Other valves for allowing the body scrub the pass through the opening are contemplated in other embodiments.

Figure 3:
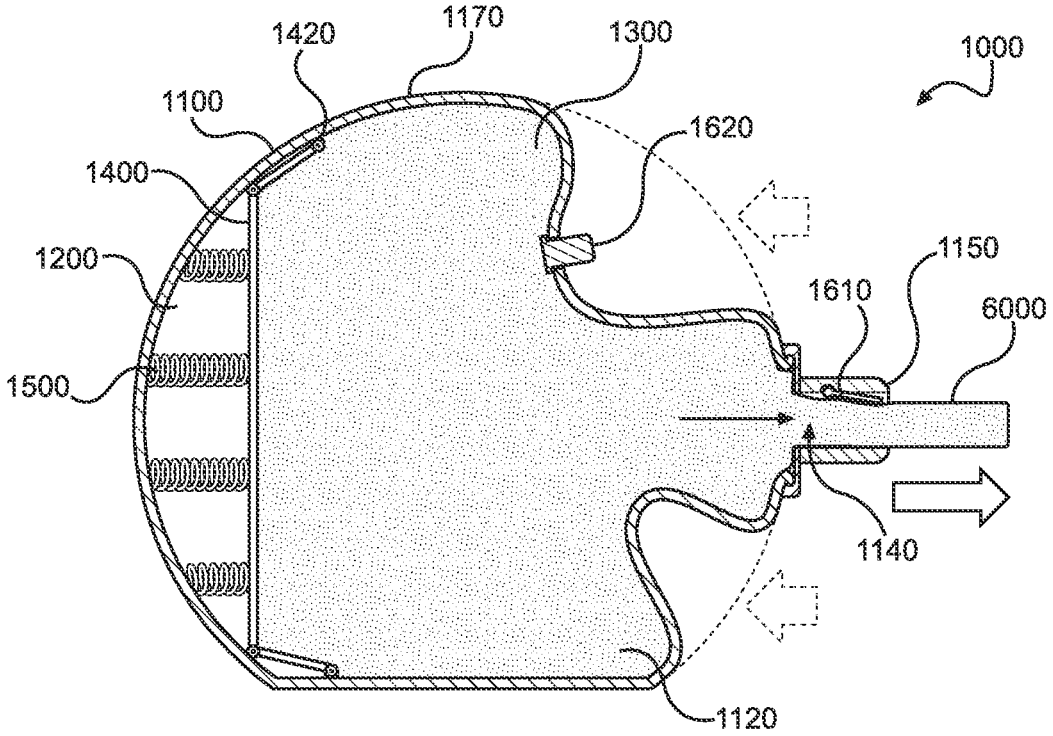
FIG. 3 shows a cross sectional view of the embodiment of the face and body scrub dispensing device wherein the housing is in a deformed configuration.
Figure 4:
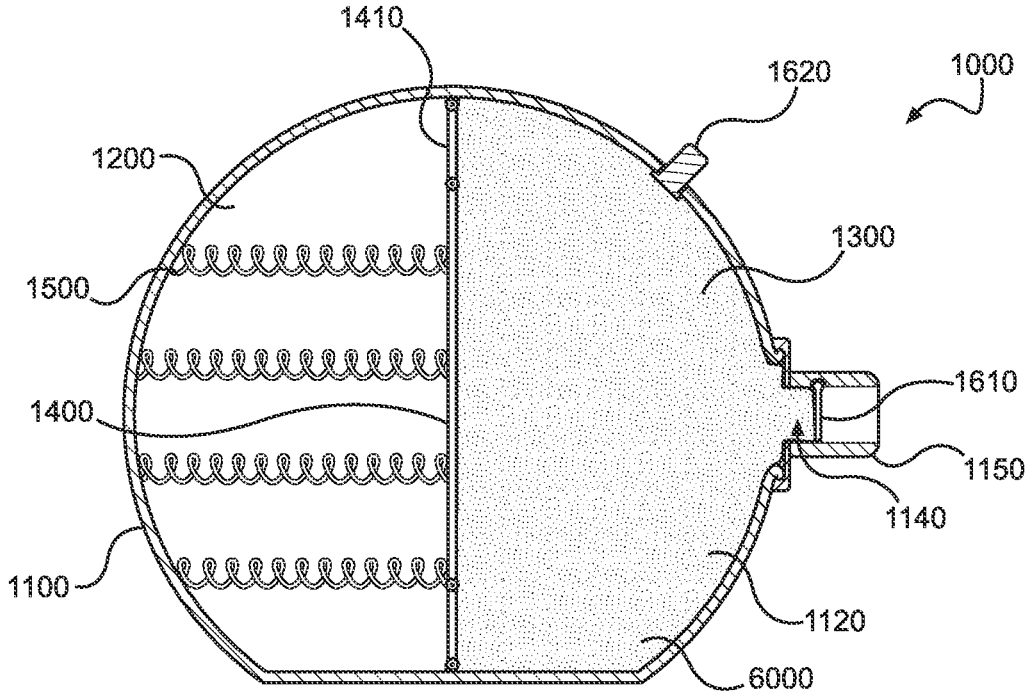
FIG. 4 shows a cross sectional view of the embodiment of the face and body scrub dispensing device wherein the housing is in another nondeformed configuration.

Referring now to FIGS. 3 and 4, there are shown cross sectional views of the embodiment of the face and body scrub dispensing device wherein the housing is in a deformed configuration and a nondeformed configuration, respectively. The housing 1100 is movable between a nondeformed configuration (as seen in FIGS. 1, 2, and 4) and a deformed configuration (as seen in FIG. 3). In the illustrated embodiment, the valve 1600 is configured to close when pressure is released from the interior volume 1120 causing the housing 1100 to return to the non-deformed configuration. In the illustrated embodiment, the pressure is released from the interior volume 1120 via a pressure relief valve 1620, wherein the pressure relief valve 1620 is actuated via pushing on the pressure relief valve 1620 which is in the form of a button. When the pressure relief valve 1620 is in a resting state, a seal is formed between the housing 1100 and the pressure relief valve 1620 to prevent air from passing into the housing until actuated. When the pressure relief valve 1620 is actuated and in a depressed state, airflow is permitted to pass from the exterior of the housing to the interior volume thereof, thereby normalizing pressure within the housing and allowing for the shape of the housing to return to the initial globelike state. In the illustrated embodiment, the seal prevents body scrub from passing through the pressure relief valve, but allows air to freely pass from the interior volume through to the exterior of the housing.

In some embodiments, the pressure relief valve is a ball valve, wherein other embodiments, the pressure relief valve is any suitable valve type configured to release airflow when actuated, such as a plug that can be removed and replaced within the valve. In other embodiments, the body scrub dispensing device is void of a pressure relief valve and instead permits airflow to be introduced upon removal of the spout or loosening of the threaded neck.

In the illustrated embodiment, body scrub 6000 is disposed within the second side 1300 of the housing 1100, wherein the dividing wall 1400 and arms 1410 separate the first side 1200 from the second side 1300. The dividing wall 1400 and arms 1410 form a cross section of the housing 1100 and prevent body scrub from traversing into the first side of the housing. The springs 1500 are entirely disposed within the first side of the housing and provide a constant force against the dividing wall. The one-way valve 1600 prevents the body scrub from being forced through the opening 1140 and spout 1150 until the gate 1610 is lifted.

In operation, a user squeezes the second side of the housing 1100 thereby deforming the second side of the housing while keeping the first side of the housing untransformed. As the second side 1300 is deformed, the body scrub 6000 is forced through the opening 1140, thereby raising the gate 1610 towards the spout 1150 and allowing the body scrub to pass through the spout 1150. As a result of the pressure build up within the housing as the body scrub is being dispensed, the housing will remain in the deformed configuration until airflow is introduced into the interior volume of the housing. Once the user has dispensed the desired amount of body scrub, the pressure relief valve 1620 is pressed to allow air into the second side of the housing. As air fills the housing, the housing will return to its nondeformed globe-like shape. Simultaneously, the springs 1500 will force the dividing wall 1400 towards the second side 1300 causing the body scrub 6000 to displace the open spaces filled with air because the springs are biased towards an expanded configuration. The air is forced through the pressure release valve 1620 as it is being displaced by the body scrub. When the dividing wall moves closer to the second side as the spring expands. The force applied by the springs 1500 is not enough force to lift the gate 1610, only to move the body scrub forward to displace the air within the interior volume. In this way, body scrub is efficiently maintained in the housing, making it easier for the user to dispense all of the body scrub while keeping the maintaining the body scrub quality by preventing the introduction of water and other contaminants each time the body scrub is dispensed.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A face and body scrub dispensing device, comprising:

a housing comprising interior volume having a first side and a second side, wherein the housing is movable between a deformed configuration and a nondeformed configuration;

a dividing wall disposed within the interior volume, wherein the dividing wall separates the first side from the second side and is movable therebetween via a spring;

wherein the interior volume is adapted to house body scrub for dispensing;

wherein the spring is disposed within the first side of the housing and is biased towards an expanded configuration such that when the housing is moved to the deformed configuration via pressure applied to the housing, the spring pushes the dividing wall towards the second side thereby forcing the body scrub through an opening within the housing;

a one-way valve disposed at the opening, wherein the valve is configured to open as the body scrub is dispensed through the opening upon force applied to the housing;

wherein the valve is configured to close when pressure is released from the interior volume causing the housing to return to the non-deformed configuration.

2. The face and body scrub dispensing device of claim 1, wherein an upper end of the housing is globe shaped.

3. The face and body scrub dispensing device of claim 1, further comprising a release valve disposed on a sidewall of the housing configured to release a pressure from the interior volume when the housing is disposed within the deformed configuration.

4. The face and body scrub dispensing device of claim 1, further comprising a seal disposed at each end of the dividing wall, wherein the seal is configured to prevent body scrub from passing from the second side of the housing to the first side thereof.

5. The face and body scrub dispensing device of claim 1, further comprises a spout extending from the opening of the housing.

6. The face and body scrub dispensing device of claim 5, wherein the spout is removable from the housing via threaded neck to enable the housing to receive the body scrub therein.

7. The face and body scrub dispensing device of claim 5, wherein the spout is disposed on the second side of the housing perpendicular to a base of the housing.

8. The face and body scrub dispensing device of claim 1, wherein the dividing wall moves towards the second side when the spring expands.

9. The face and body scrub dispensing device of claim 1, further comprising a pair of arms hingedly secured to opposing sides of the dividing wall, wherein the pair of arms are biased towards an extended configuration.

10. The face and body scrub dispensing device of claim 9, wherein one-way the valve comprises a gate hingedly secured to a sidewall surrounding the opening, the gate having a substantially same length as a diameter of the opening such that when the gate is closed, the opening is covered by the gate.

11. The face and body scrub dispensing device of claim 9, wherein the pair of arms are configured to linearly align with the dividing wall in the extended configuration.

12. The face and body scrub dispensing device of claim 9, wherein the pair of arms are configured to move toward the second side as the dividing wall moves towards the second side.

13. The face and body scrub dispensing device of claim 9, wherein a distal end of each pair of arms is secured to an interior wall of the housing.

14. The face and body scrub dispensing device of claim 1, wherein each arm of the pair of arms comprise a length shorter than a length of the dividing wall.

15. The face and body scrub dispensing device of claim 1, wherein the dividing wall and the pair of arms form a cross section of the housing to prevent body scrub from passing to the first side thereof.

16. The face and body scrub dispensing device of claim 1, wherein the housing comprises a flat base adapted to support the housing in an upright configuration on a horizontal surface.

17. The face and body scrub dispensing device of claim 1, wherein the spring comprises a first end secured to a sidewall of the housing on the first side thereof and a second end secured to the dividing wall.

18. The face and body scrub dispensing device of claim 1, wherein the first side remains nondeformed as the second side is disposed in the deformed configuration.

19. The face and body scrub dispensing device of claim 1, wherein the interior volume of the first side increases as the interior volume of the second side is decreased.

* * * * *